US005467727A

United States Patent [19]

Godvin et al.

[11] Patent Number: 5,467,727

[45] Date of Patent: Nov. 21, 1995

[54] PILE MOORING DEVICE FOR BOATS

[76] Inventors: Gerard B. Godvin, 111 Lazier Rd., Budd Lake, N.J. 07828; Charles F. Kolb, Jr., 247D Birch St., Old Bridge, N.J. 08857

[21] Appl. No.: 206,888

[22] Filed: Mar. 7, 1994

[51] Int. Cl.[6] ..... B63B 21/00

[52] U.S. Cl. ..... 114/230

[58] Field of Search ..... 114/230, 293; 441/3

[56] References Cited

U.S. PATENT DOCUMENTS

| | | | |
|---|---|---|---|
| 2,990,803 | 7/1961 | Henderson | 114/230 |
| 3,001,371 | 9/1961 | Gilmore . | |
| 3,401,413 | 9/1968 | Anselmi | 114/230 |
| 3,430,598 | 3/1969 | Soderberg . | |
| 3,486,342 | 12/1969 | Aks . | |
| 4,480,576 | 11/1984 | Mills . | |
| 4,864,956 | 9/1991 | Onstwedder, Jr. . | |
| 5,050,521 | 9/1991 | Stone . | |
| 5,133,276 | 7/1992 | Alesi, Jr. et al. . | |
| 5,235,929 | 8/1993 | Chester et al. . | |

*Primary Examiner*—Stephen Avila
*Attorney, Agent, or Firm*—William Squire

[57] ABSTRACT

A hollow toroidal member of high-strength material for withstanding mooring loads has a central opening which slips over a mooring pile. A reinforcing ring is preferably secured in the core of the member to provide additional load-bearing capability to the device. A pair of diametrically opposite mooring openings are formed in the member and ring each opening for receiving a boat mooring line, the openings in the member and ring being aligned. The member is preferably molded with its core in fluid isolation from the ambient atmosphere to provide buoyancy. In the alternative, the core is filled with floatation material. A pair of apertured legs may be used in place of the openings in the member for securing the mooring lines thereto.

20 Claims, 2 Drawing Sheets

PILE MOORING DEVICE FOR BOATS

BACKGROUND OF THE INVENTION

This invention relates to mooring devices for securing a boat to a pile, and more particularly, to floating devices for use in tidal waters which fluctuate in depth.

In tidal waters, the surface of the water rises and falls with the tides. Mooring boats to a fixed mooring point creates a problem in that the boat rises and falls with the tide. Therefore, with fixed mooring points, the mooring line needs to be kept sufficiently slack to allow the boat to rise and fall with the tide. Yet the boat needs to be kept sufficiently secure to prelude bumping the pile and damaging the boat. One solution is to moor the boat to a floating dock and to a fixed choker line attached to a pile. However, if a floating dock is not readily available, other mooring devices are required.

Another solution is disclosed in U.S. Pat. No. 3,486,342 to Aks. This patent discloses an elongated cylindrical pile mooring bumper with a relatively complex configuration including a hitch ring, a supporting column and a bumper collar. The bumper collar and hitch ring are axially spaced from each other with a padded canvas sheath. This is a relatively costly device, is relatively heavy and therefore, not readily portable and cumbersome to implement.

A relatively complex mooring system is disclosed in U.S. Pat. No. 5,050,521 to Stone. This system uses an array of rollers and a complex mooring tie down arrangement. The rollers permit the mooring line to rise and fall with the tide by rolling up and down the piles.

U.S. Pat. No. 3,430,598 discloses a system for mooring a boat in a lake using portable poles inserted into the lake bottom and hollow drums which slide on the poles. The drums are especially adapted to slide along the poles and include upper and lower sleeves. This type of container is not readily adapted for sliding on available piles and requires the specially sized poles for use therewith. U.S. Pat. No. 4,480,576 shows another roller arrangement including carriages which ride along the piles. This is also a complex and costly system and not readily portable.

SUMMARY OF THE INVENTION

A mooring device according to the present invention for use with at least one mooring pile to which a boat is to be moored comprises an annular member of any annular outer peripheral shape arranged to float on water, the member having a central opening for receiving the at least one pile therethrough, the opening being arranged to permit the member to slide along the pile in response to changes in water level about the pile. The member includes means for withstanding mooring loads induced therein by the boat. Means are included for securing a mooring line to the member.

In accordance with one embodiment, the member is hollow with an annular core, the means for securing comprising an opening formed in the member through the core and through which opening the line may pass.

In a further embodiment, the device includes an annular reinforcing element in the core.

In a still further embodiment, a further opening is formed in the annular element in alignment with the member opening.

IN THE DRAWING

DETAILED DESCRIPTION OF THE PREFERRED EMBODIMENTS

Figure 1:
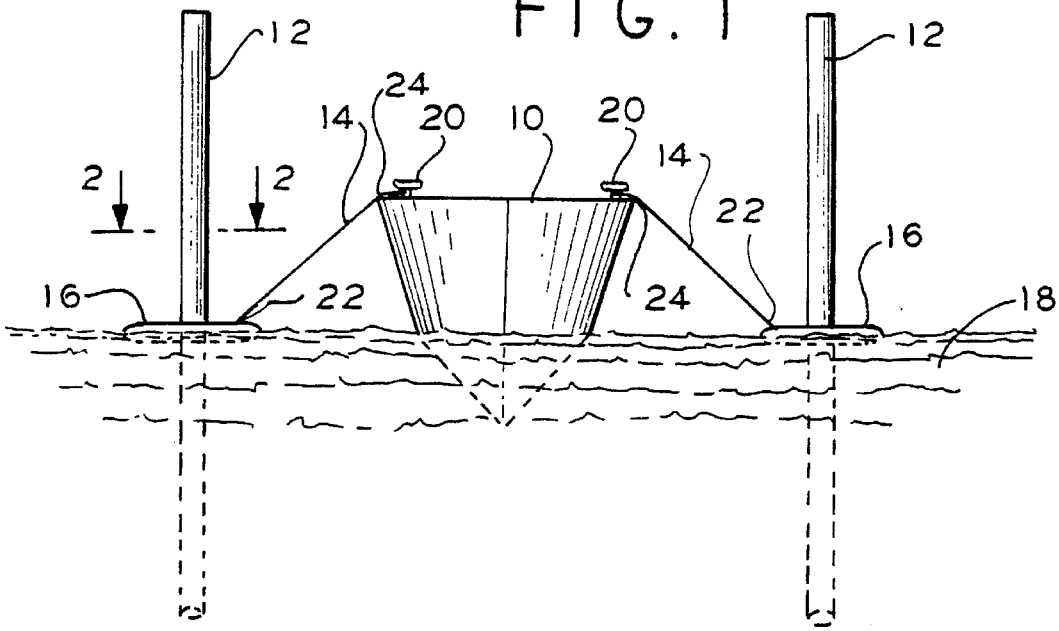
FIG. 1 is an elevation view of a mooring device arrangement according to one embodiment of the present invention for securing a boat to and between a pair of piles.

In FIG. 1 a boat 10 is moored to piles 12 via mooring lines 14 attached to mooring devices 16 according to one embodiment of the present invention. The boat 10 and devices 16 all float on water 18 which rises and falls with the tides. The lines 14 are each attached at one end 22 to a device 16 and at the other line end 24 to a cleat 20 on the boat.

Figure 2:
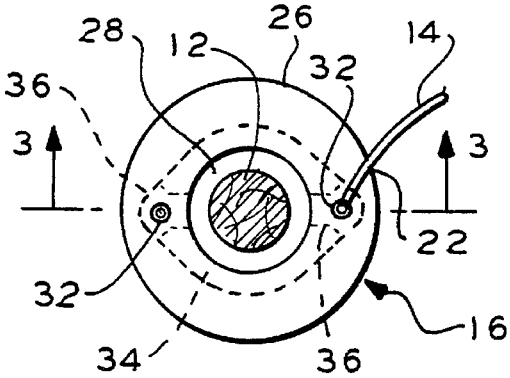
FIG. 2 is a plan sectional view taken through the plane 2—2 of FIG. 1 illustrating one of the mooring devices.
Figure 3:
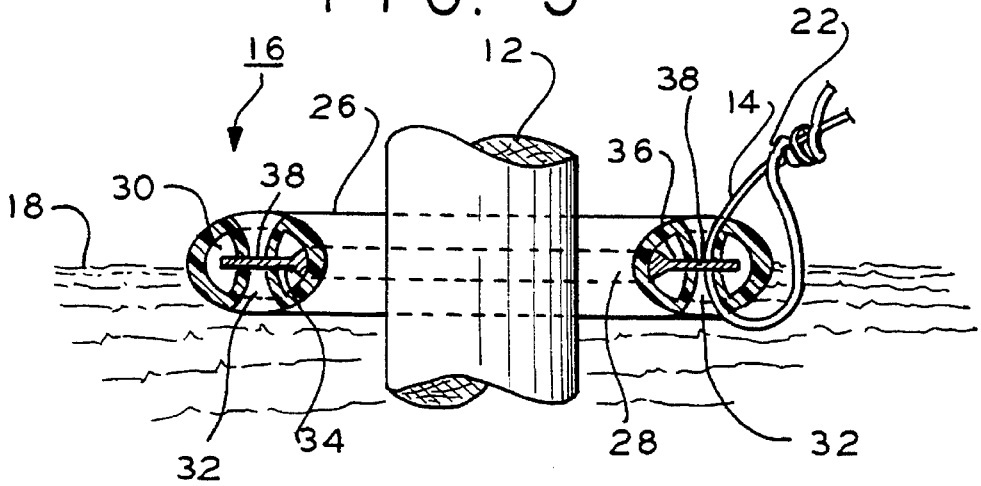
FIG. 3 is a sectional elevation view of the embodiment of FIG. 2 taken through the plane 3—3 of FIG. 2.

In FIGS. 2 and 3, device 16 comprises a preferably toroidal shaped hollow member 26 having a somewhat elliptical cross section. In the alternative, the member 26 may be circular in cross section or flattened to a greater degree than shown. This is not critical. The member 26 in plan view, FIG. 2, is preferably circular, but could have any other annular outer geometric peripheral shape, such as square, rectangular or diamond, by way of example. Therefore, in the claims the term "generally toroidal" refers to a peripheral geometry that includes circular, elliptical, square, rectangular, diamond shaped or any other polygon or curved peripheral shape. The member 26 has a central, preferably circular, opening 28.

Opening 28 is greater in diameter than the outer diameter of a pile 12 so the member 26 may readily slide along the corresponding pile 12 with the rise and fall of the tides. Pile 12 as shown is a typical wood pile of the type well recognized to be found at marinas and other boating facilities. These piles may vary somewhat in diameter and typically have somewhat rough external surfaces. Therefore, the opening 23 is sufficiently large to be received by any of the mooring piles randomly selected regardless the external surface roughness and diameter.

Preferably, the member 26 is molded impact resistant thermoplastic, but may be any impact resistant floatable material, solid or hollow. This material is sufficiently strong to withstand the mooring forces induced by a floating boat moored thereto. As shown, member 26 is hollow with a sealed core 30. In the alternative, the core 30 need not be sealed, but the member in this case is made of floatation material or in the alternative, the core is filled with floatation material. A pair of through openings 32 on diametrically opposite sides of member 26 are formed in member 26. An annular, preferably metal, ring member 34 is secured in the core 30 of member 26. Ring member 34 may be fabricated of high strength materials other than metal for the purpose of securing a boat thereto and withstanding the mooring forces of the boat. Ring member 34, which is preferably generally planar, has a pair of ears 36, one aligned in each opening 32. Each ear has a hole 38 therethrough aligned in a corresponding opening 32. Preferably, the ring member 34 is of thicker material throughout and thinner at the ears 36. While two openings 32 and ears 36 are shown, more or fewer can be provided in accordance with a given implementation. The ring member may be omitted where the member 26 is made of high-strength material sufficient to withstand the mooring induced forces. Also, the core 30 may include molded ribs not shown, integral with member 26, for reinforcing the member 26.

The openings 32 are in fluid isolation from the member 26 core 30 so as to preserve the integrity of the hollow core and seal the core from the ambient atmosphere to maintain the buoyancy of the member 26 by reason of the hollow core. In the alternative, the core may be filled with buoyant material such as wood or the like and the core 30 in this case need not be fluid tight relative to the ambient atmosphere. For example, by making member 26 of two mating halves which are attached together by snap fasteners and the like (not shown), the core may be filled with the desired floatation material. By molding the member 26 with the ring member 34 as an integral unit, the member 26 core 32 may be formed water impervious with respect to the member 26 external surfaces.

Figure 6:
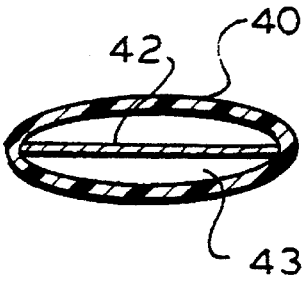
FIGS. 6 and 7 are sectional elevation views of further embodiments of the present invention.
Figure 7:
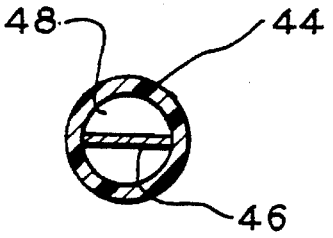

In FIG. 3, the member 26 has a somewhat elliptical cross sectional shape. In FIG. 6, the corresponding member 40 has a more flattened elliptical shape with a reinforcing central metal ring 42 in core 43. In FIG. 7, in contrast, the member 44 is circular in cross sectional shape. A reinforcing metal ring 46 is in the core 48 of member 44 to provide additional structural support for the forces induced by a boat. The rings 42 and 46 are molded integral with the corresponding members 40 and 44, respectively. The mooring line receiving openings 32 are somewhat hour glass shaped with narrower central regions and wider egresses. The ring member 34 holes 38 are preferably the same diameter as the opening 32 in member 26.

By way of example, the member 26 may be formed of impact resistant ABS plastic material (acrylonitrile butadiene styrene) or, in the alternative, impact resistant rubberized materials may be used. The particular shape of the member 26 will be governed by weight and size requirements of a given implementation, e.g., boat and piling sizes. The reinforcing ring member 34 can be formed of reinforced high strength engineering plastic material, and may be fiberglass reinforced, for withstanding the mooring induced stresses. Also, the member 26 may be formed of reinforced high strength rubber or any other moldable or suitable impact resistant material for absorbing impacts with the boat and for absorbing mooring loads.

By making the member 26 and ring member 34 of lightweight plastic they may be molded as an integral unit. If formed of separate elements, these elements may be connected utilizing recessed mechanical connectors (not shown) such as stainless steel straps, bands, bolts and so on.

Figure 4:
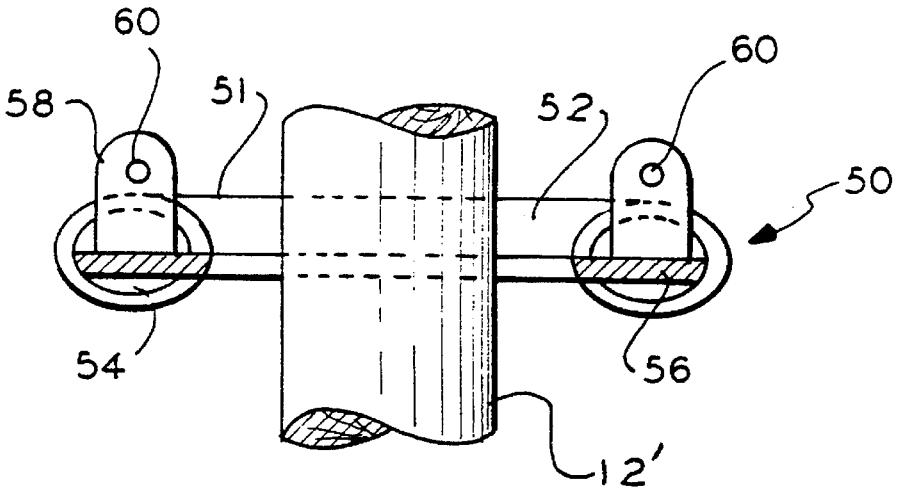
FIG. 4 is a sectional elevation view similar to FIG. 3 of a second embodiment of the present invention.

In FIG. 4, device 50 comprises a generally toroidal member 51 having a central opening 52 and a hollow core 54 which is fluid sealed from the ambient atmosphere. By generally toroidal is meant that the member 51 as the corresponding members in FIGS. 2 and 3, need not be circular in cross section but may have other shapes but are generally toroidal in configuration. An annular planar ring 56, preferably sheet metal, is secured to member 51 in core 54. A leg 58 upstands from ring 56 on one side of the member 51 and a second leg 58 upstands from ring 56 on the diametrical opposite side of member 51. Each leg 58 has a mooring line receiving aperture 60. Legs 58 preferably are metal but also may be other materials. For example, the ring 56 and legs 58 may be high strength engineering plastics. A pile 12' fits in the central opening 52 of member 51 with sufficient clearance to permit the floating member 51 to slide up and down the pile 12' with changes in tides.

Figure 5:
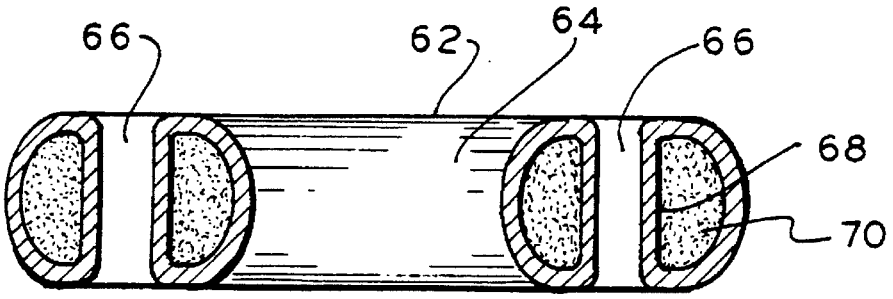
FIG. 5 is a sectional elevation view similar to FIG. 3 of a third embodiment of the present invention.

In FIG. 5, another embodiment is illustrated in which toroidal member 62 is formed with a central opening 64 and a pair of mooring line receiving openings 66. The core 68 of the member 62 is filled with floatation material 70 such as cork, wood or other floatation materials.

In operation, the devices 16, FIGS. 1–3 are normally carried on the boat 10 in one embodiment. When it is desired to moor the boat 10, the devices 16 with one end 22 of the mooring lines 14 attached as shown are easily placed over the piles 12 and slide down to the floating position. The lines 14 are sufficiently long such that the boater can maneuver to each pile in turn. With the boat positioned as in FIG. 1, the lines 14 are then tightened about the cleats 20.

The devices 16 are relatively small, easily handled, lightweight and placed in position by one person. The devices readily slide down the piles and float in position rising and falling along the piles with changes in tides. Because the devices 16 are easily handled, they are readily removed by the boater when ready to depart. The devices are relatively simple and low cost as well as portable, if desired, or permanently located at a particular pile if desired. In the latter case, heavier, larger devices 16 may also be used.

It should be understood that various modifications may be made to the disclosed embodiments without departing from the scope of the invention. The described embodiments are by way of illustration and not limitation, the scope of the invention being defined by the appended claims.

What is claimed is:

1. A mooring device for use with a plurality of conventional wooden cylindrical mooring piles exhibiting a plurality of corresponding different outer diameters and surface roughness to which a boat is to be moored, said device comprising:

an annular member of any geometric annular outer peripheral shape arranged to float on water, said member having a central opening sufficiently large for receiving any of said piles therethrough in spaced relation thereto, said opening being dimensioned to permit the member to slide along the received pile in response to changes in water level about the received pile, said member including means arranged to withstand mooring loads induced therein by said boat; and means for securing a mooring line to said member.

2. The device of claim 1 wherein the member is hollow with an annular core, said member having an internal annular curved surface forming said opening, said means for securing comprising a first further opening formed in said member through said core and through which said first further opening said line may pass, said curved surface for selective engaging any of said piles in substantial point contact to minimize friction with the engaged pile.

3. The device of claim 2 wherein the device is molded thermoplastic.

4. The device of claim 2 including an annular reinforcing element in and extending about said core.

5. The device of claim 4 wherein a further opening is formed in said annular element in alignment with said member opening.

6. The device of claim 5 wherein said element is metal and said member is thermoplastic.

7. The device of claim 2 including floatation material in said core.

8. The device of claim 1 wherein the member has a hollow core and said means for securing comprises an opening through said member in fluid isolation from said core.

9. The device of claim 4 wherein said element is sheet material with at least one ear having an aperture aligned with said member opening for receiving said mooring line therethrough.

10. The device of claim 1 wherein the member lies in a plane, said means for securing comprising at least one leg upstanding from said member plane, said at least one leg having a mooring line receiving aperture therein.

11. The device of claim 10 including a sheet material ring embedded in said member, said at least one leg being integral with said ring.

12. The device of claim 11 wherein the member has a hollow annular ring-like core, said ring being in said core.

13. The device of claim 1 wherein the member has a circular cross section.

14. The device of claim 1 wherein the member has an elliptical cross section.

15. A mooring device for use with a plurality of conventional wooden cylindrical mooring piles exhibiting a plurality of corresponding different external diameters and surface roughness to which a boat is to be moored, said device comprising:

a generally toroidal hollow core member arranged to float on water, said core being toroidal, said member having a central opening sufficiently large for receiving any of said piles therethrough in spaced relation thereto, said opening being arranged to permit the member to slide along the received pile in response to changes in water level about the received pile, said member including means for withstanding stresses induced by a boat moored thereto; and aperture means coupled to the member for receiving and securing a mooring line to said member.

16. The device of claim 15 including a ring-like element secured in the core, said aperture means including said element having an opening for receiving said line therethrough.

17. The device of claim 15 including means for forming an aperture through said member in fluid isolation with said core.

18. The device of claim 15 wherein the member core has a flattened shape in cross section, the core member having an internal curved surface forming said opening for providing substantial point contact with the received pile.

19. The device of claim 15 wherein the member has a circular shape in cross section.

20. The device of claim 15 wherein the member has an elliptical shape in cross section.

* * * * *

UNITED STATES PATENT AND TRADEMARK OFFICE

CERTIFICATE OF CORRECTION

PATENT NO. : 5,467,727

DATED : Nov. 21, 1995

INVENTOR(S) : Godvin, et al.

It is certified that error appears in the above-identified patent and that said Letters Patent is hereby corrected as shown below:

Col. 4, line 61, after "a" insert --second--.

Line 63, after "member" insert --first further--.

Signed and Sealed this

Twenty-seventh Day of February, 1996

*Attest:*

Bruce Lehman

BRUCE LEHMAN

*Attesting Officer*

*Commissioner of Patents and Trademarks*